United States Patent [19]

Reichert

[11] 4,412,542

[45] Nov. 1, 1983

[54] ROBE GARMENT FOR MASTECTOMY PATIENT

[76] Inventor: D. Jeanie Reichert, E. 1415 - 18th Ave., Spokane, Wash. 99203

[21] Appl. No.: 399,199

[22] Filed: Jul. 19, 1982

[51] Int. Cl.[3] ..... A41C 3/08; A41C 1/06; A41C 3/10

[52] U.S. Cl. ..... 128/455; 128/435; 128/478; 128/454

[58] Field of Search ..... 128/454, 455, 435, 434, 128/481, 478, 480

[56] References Cited

U.S. PATENT DOCUMENTS

| | | | |
|---|---|---|---|
| 2,896,630 | 7/1959 | Adler | 128/454 |
| 3,173,420 | 3/1965 | Mazzoni et al. | 128/478 |
| 3,316,915 | 5/1967 | Howell | 128/454 |
| 3,348,241 | 10/1967 | Dodds | 128/478 |

*Primary Examiner*—Doris L. Troutman
*Attorney, Agent, or Firm*—Wells, St. John & Roberts

[57] ABSTRACT

A robe garment is described for a mastectomy patient in which the garment extends from a neckline downward to a bottom hem below the patient's knees. The robe garment has a front opening to enable a patient to put on or take off the garment. The robe garment has an inner panel that extends across the patient's back, around the patient's side to a front panel section having a pair of breast cup members that are connectable at the front opening. Each breast cup member is formed with a pocket to receive a soft pillow-like breast prosthesis. The inner panel has a lower tension member along the bottom thereof that extends about the body below the breast line. An outer layer is connected to the inner layer along the shoulder straps and the back neckline, and is draped downward over the inner layer to the bottom hem.

9 Claims, 7 Drawing Figures

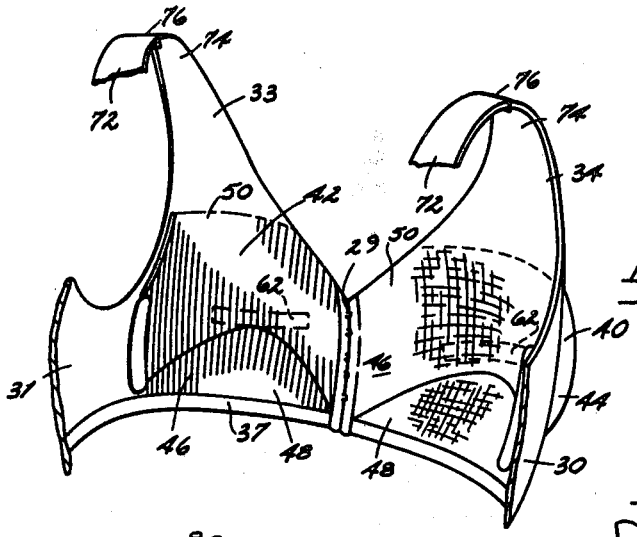
FIG 3
FIG 4
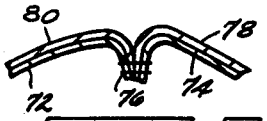
FIG 7
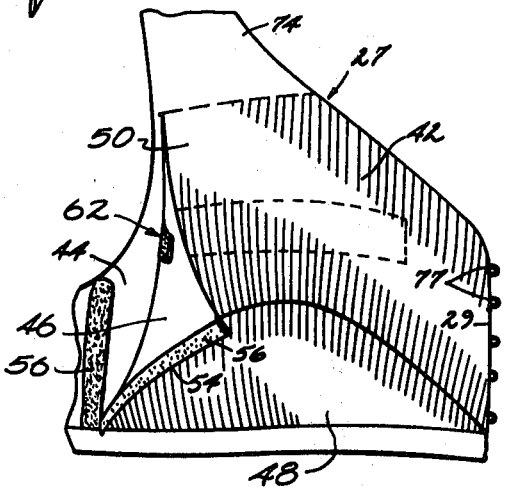
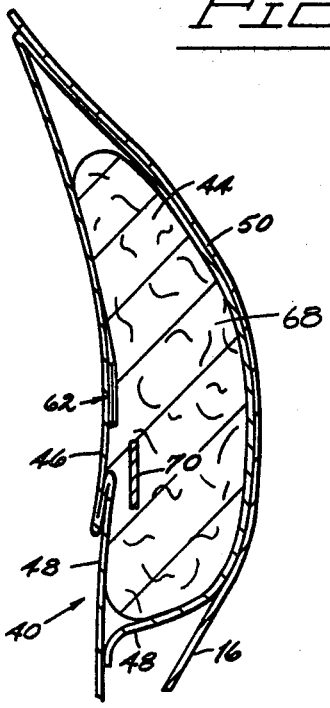
FIG 5
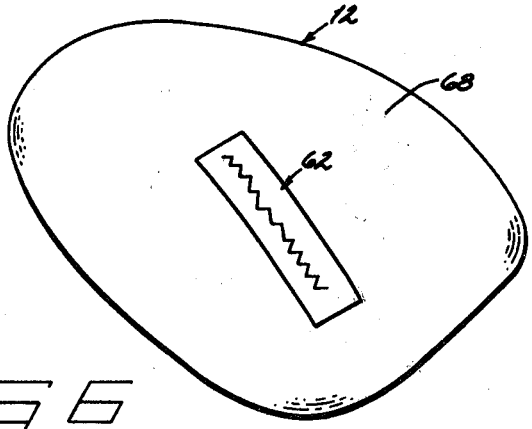
FIG 6

ROBE GARMENT FOR MASTECTOMY PATIENT

BACKGROUND OF INVENTION

A mastectomy operation normally leaves a mastectomy patient partially or significantly disfigured. Prosthesis devices have been devised to artificially replace the removed breast tissue to assist mastectomy patients to project a normal figure similar to the patient's figure prior to operation. In the past mastectomy patients have been restricted greatly in the variety of garments that will accommodate the breast prosthesis and which will not overly restrict the patient's activities and movements. The prosthesis devices are intended to normally simulate the natural breast when the patient is upright.

It is even more difficult to provide a robe type garment for mastectomy patients that enables the mastectomy patient to project a normal profile, yet enable the patient to quickly put on the robe and to utilize the robe in both the standing and resting posture, particularly when the patient desires to rest in the prone position on her stomach. The prosthesis device normally makes the stomach-prone position very uncomfortable and greatly restricts the ability of the patient to rest and sleep while wearing a robe-type garment.

This invention provides a unique robe garment for mastectomy patients which greatly increases the confidence of the mastectomy patient to be able to quickly put on the robe garment to answer a door or meet a visitor without having to completely change into more formal attire such as a dress and the like.

BRIEF DESCRIPTION OF THE DRAWINGS

A preferred embodiment of this invention is illustrated in the accompanying drawings; in which:

FIG. 3, is a fragmentary rear view of a cutaway portion of the inner layer of the robe garment illustrating a back side of breast cup members;

FIG. 4 is a fragmentary enlarged view of a section of a left breast cup member illustrating a prosthesis pocket that is closable;

FIG. 5 is a vertical cross-sectional view of one of the breast cup structures illustrating the location of a prosthesis and the draping of the outer layer over the inner layer;

FIG. 6 is an isometric view of a breast prosthesis for placing within the pocket of one of the breast cup members; and FIG. 7 is a cross sectional view taken along line 7—7 in FIG. 2 illustrating the seam structure in which the inner and outer layers of the robe are interconnected forming a unitary garment.

DETAILED DESCRIPTION OF A PREFERRED EMBODIMENT

The following disclosure is submitted in compliance with the purpose of the United States Constitution "to promote the progress of science and useful arts" (Article I, Sec. 8).

Figure 1:
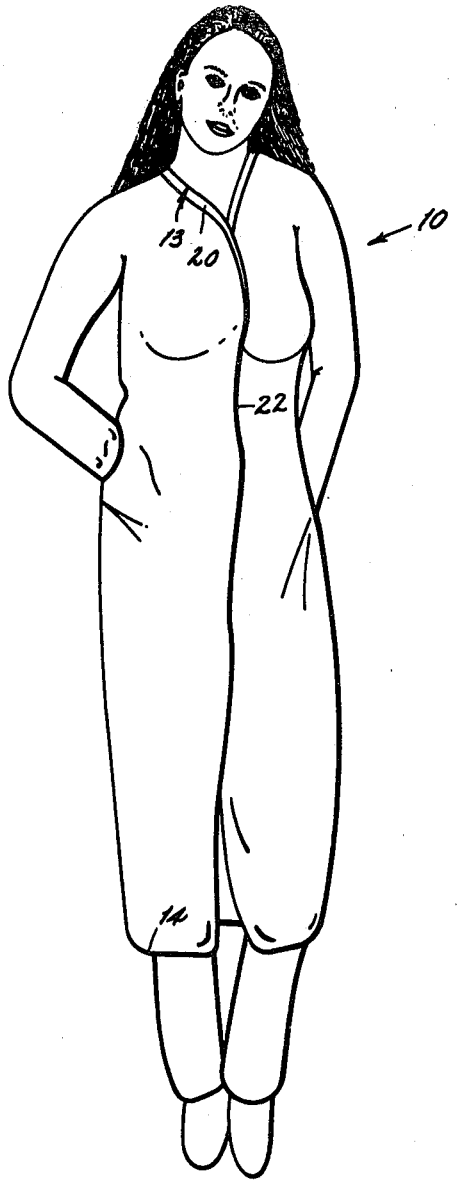
FIG. 1 as an isometric view of a mastectomy patient wearing a robe garment which is the subject of this invention.

Referring to the drawings there is illustrated in FIG. 1 a robe garment generally designated with the number

10 for use by mastectomy patients to receive one or two breast prosthesis 12 depending upon whether or not the patient has had a single or a double mastectomy operation. The robe garment extends from a neckline 13 to a hemline 14 below the patient's waist and preferably below the patient's knees. The neckline 13 includes a front neckline section 20 that extends across the patient's chest from a front opening 22 upward in opposite directions to the top of the shoulders and a back neckline 21 that extends from the top of the shoulders across the back of the patient. The back neckline 21 is preferably elevationally above the patient's breastline. The neckline 13 encircles the patient's neck and forms the uppermost portion of the garment.

Figure 2:
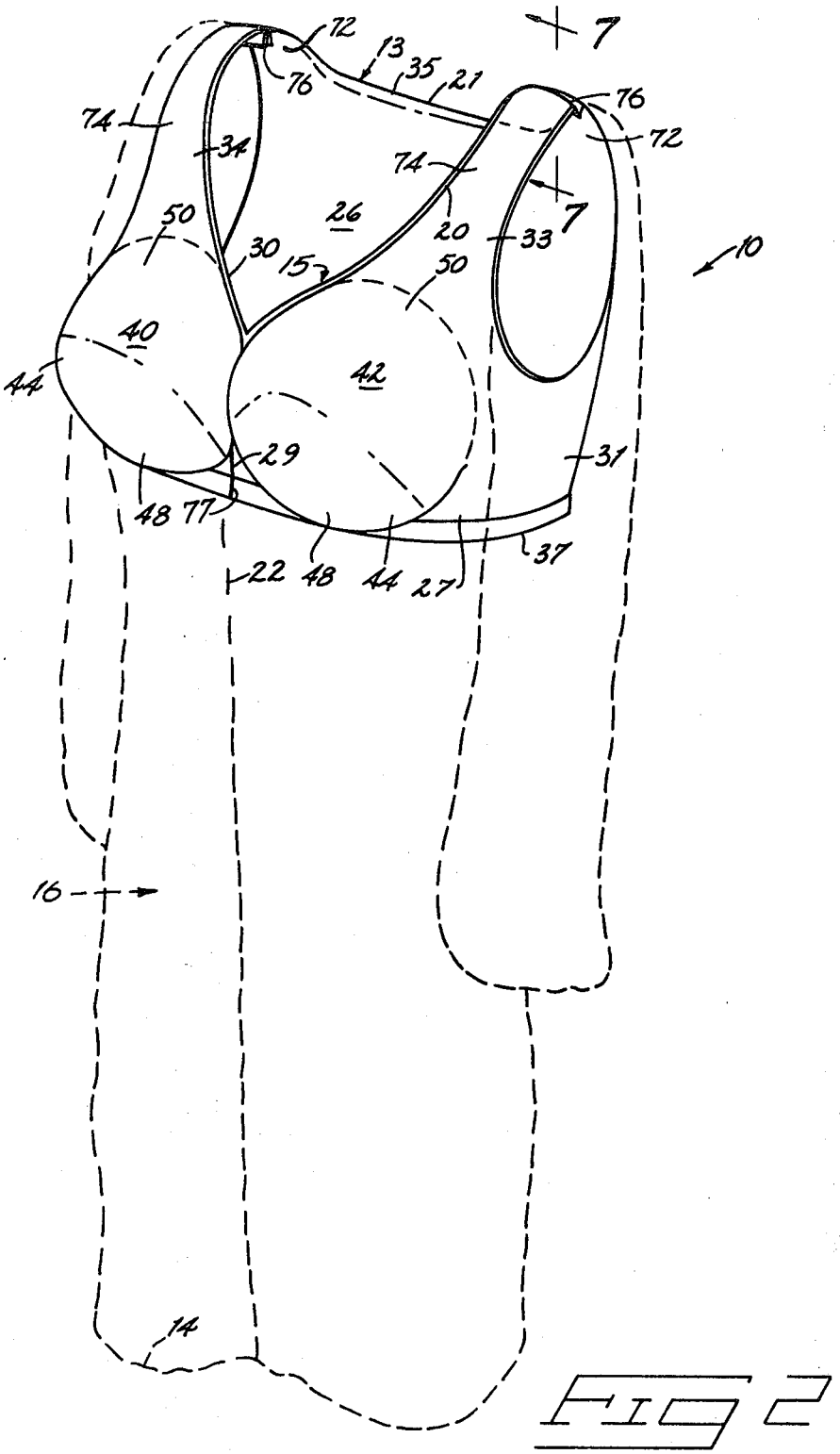
FIG. 2 is an isometric view of the robe garment with an outer layer of the garment illustrated in dotted line and an inner layer of the garment illustrated in solid line.

The important components of the garment are an inner panel 15 (FIG. 2) that extends from the neckline 13 to a rib tension member 37 that is below the breastline of the patient and an outer panel 16 that is draped over the inner panel 15 and extends from the neckline 13 to the hemline 14. The inner garment panel 15 is intended to generally contact the patient's skin; however, some patients may desire to wear an under garment such as a nightgown between the patient's skin and the robe. The inner garment panel 15 includes a back panel section 26 and a front panel section 27. The front panel section 27 has a vertical opening 29 that forms part of the front opening 13. The front and back panel sections 26, 27 are interconnected by side panel sections 30 and 31. In the preferred embodiment the back panel section 26 and the side panel sections 30 and 31 are formed of an integral piece of fabric material with the upper portion of the back panel section 26 being sewn to a neckline tension member 35 that extends across the back at the neckline. Preferably the inner panel is constructed of a fabric material that is non-stretchable in the vertical direction. Neckline tension member 35 is connected to shoulder straps 33 and 34 at opposite ends thereof. The shoulder straps 33 and 34 extend over the patient's shoulders and interconnects the back panel section 26 with the front panel section 27 along the neckline 20. An important feature of this invention is provision of the neckline tension member 35 and rib tension member 37 to provide vertical tension on the back panel section 26. The rib tension member 27 circumscribes the body and extends along and is connected to and forms part of the back panel section 26, the side panel sections 30, 31 and the front panel section 27. Ends of the rib tension member 37 are interconnectable at the vertical opening 29.

The front panel section 27 includes a pair of breast cup members 40 and 42, for receiving and supporting either a natural breast of the patient or for receiving a breast prosthesis for simulating a natural breast. Each of the breast cup members 40, 42 includes a front wall 44 formed of structural fabric that projects outward with structural form to define the contour of the front panel 27 and to deflect the outer garment panel 16 to simulate a natural breast contour. The breast cup members 40, 42 additionally include a back wall 46 forming a prosthesis pocket or cavity. The back wall is made of a soft highly pliant material in which the back wall may be either projected outward to conform to the shape of the front wall 44 to support a natural breast or to receive a breast prosthesis 12 in the pocket as illustrated in FIG. 5. Consequently each of the breast cup members 40, 42 may receive and support a natural breast or receive and support a breast prosthesis. Each of the front walls 44 and each of the back walls 46 include a crescent shaped lower fabric part 48 and enables the walls to project outward. A complementary shaped upper fabric part 50 is provided to be sewn to the crescent shaped lower part 48.

The back wall 46 is sewn to the front wall 44 except along a side edge 54, forming a prosthesis opening. A closure mechanism 56 is formed along the side edge to open and close the opening to permit a breast prosthesis 12 to be inserted or removed as desired. Preferably the closure 56 is formed with "Velcro" tape material that is a highly flexible and washable. Additionally, each of the back walls 46 has a securing means 62 for securing a breast prosthesis 12 in place to the wall 46 to prevent the prosthesis from moving, either vertically or horizontally within the pocket. Preferably the securing means 62 includes a fastener member affixed to the back of the breast prothesis as illustrated in FIG. 6 and a complementary fastener member secured to the inside surface of the back wall 46.

In the preferred embodiment the breast prothesis 12 is made of a soft padding material 68 that may be easily compressed so that the patient may sleep or rest on her stomach without the prothesis feeling like a "solid lump". Such soft padding makes the breast prothesis seem like a pillow. In a preferred embodiment the breast prosthesis has a flat weight 70 (FIG. 5) that is mounted within the soft padding 68 to cause the breast prosthesis to more accurately simulate the weight of a natural breast when being supported in the prosthesis pocket.

Each of the shoulder straps 33, 34, include a shoulder strap segment 72 that is a fixed or formed integrally with the back panels section 26 and extends upward over the back portion of the shoulder for connecting to a shoulder strap segment 74 that extends downward connecting to or forming an integral part of a respective breast cup member 40, 42. The shoulder strap segments 72 and 74 are interconnected by a sewn seam 76. Additionally, the front panel section 27 includes front opening fasteners 77 along the sides of the breast cup members 40, 42 for interconnecting the breast cup members when the robe garment is placed on the body and for easily being unfastened to permit the easy removal of the garment from the patient. The front fasteners 77 are a part of the front opening 13 of the garment.

The outer garment panel 16 includes a back segment 78 (FIG. 7) that extends from the shoulder and is draped over the back panel section 26 downward to the hemline 14. The outer garment panel 16 also includes a front segment 80 that is sewn to the back segment 78 at the shoulder seam 76 and extends downward in a draped manner over the front panel of the inner garment to the hemline 14. Preferably, the inner garment panel 15 and the outer garment panel 16 are sewn together only at the seam 76 and along the back neckline 18. Otherwise the inner and outer garment panels are unconnected except along the front opening 22 of the garment where the inner and outer panels 15 and 16 overlap (i.e. along the front opening fasteners 77).

It can be readily understood from the above described embodiment that the robe is constructed so that the patient can easily and quickly put the garment on and take it off. Frequently a robe is utilized in unexpected situations in which a doorbell rings or a visitor appears prior to the patient becoming fully dressed. Additionally, a robe is a very convenient garment for lounging and for use an an outer sleeping garment. The robe is very versatile to enable the patient to enjoy considerable maneuverability and comfort even when the patient is resting on her stomach. Additionally, the robe provides a "natural" figure contour when the patient is upright or in a sitting position. Such a garment helps a mastectomy patient from "hiding" in her bedroom until the "coast is clear" before appearing in a semi-dressed condition. The robe garment enables the patient to enjoy the mental freedom with the knowledge that she looks "natural" in an informal setting and is able to perform morning and evening activities that are normally conducted in an informal atmosphere in which a robe is appropriate without the mental anguish that frequently haunts mastectomy patients.

In compliance with the statute, the invention has been described in language more or less specific as to the robe structure features. It is to be understood, however, that the robe garment is not limited to the specific features shown since the means in construction herein disclosed comprise a preferred form of putting the robe garment into effect. The robe garment is therefore claimed in any of its forms or modifications within the proper scope of the appended claims, appropriately interpreted in accordance with the doctrine of equivalents.

I claim:

1. A robe garment for a mastectomy patient, comprising:

an inner garment panel having a closable front opening for circumscribing the upper torso of the patient;

said inner garment panel having an elongated lower tension member for circumscribing the patient's torso below the breastline;

said inner garment panel having a back panel section extending vertically from a rear garment neckline to the lower tension member and laterally across the back of the garment;

said inner garment panel having a pair of interconnectable breast cup members affixed to the lower tension member for receiving and supporting either natural breasts or breast prosthesis;

said inner garment panel having elongated shoulder straps interconnecting the breast cup members and the back panel section for extending upward over the respective shoulders of the patient;

an elongated outer garment panel affixed to inner garment panel along the shoulder strap members and draped downward over the inner garment panel and of sufficient length to extend below the patient's waist and having a front opening to enable the patient to ingress and regress from the garment through the front opening when the breast cups are unconnected.

2. The robe garment of claim 1 wherein each of the breast cup members include a prosthesis pocket for receiving a breast prosthesis.

3. The robe garment of claim 2 wherein each prosthesis pocket includes a securing means for securing a prosthesis in a desired orientation and location within the pocket.

4. The robe garment of claim 2 wherein each breast cup member includes a front wall that projects outward from the patient's body and the back wall complementary to the front wall for deflecting outward against the front wall when supporting a natural breast and for forming the prostheis pocket in cooperation with the front wall to receive a breast prosthesis.

5. The robe garment of claim 2 whwerein the prosthesis pocket has an opening for permitting the bresast prosthesis to be inserted and removed from the prosthesis pocket and wherein the prosthesis pocket includes enclosing means for enclosing the pocket opening to retain the prosthesis in the prosthesis pocket.

6. The robe garment of claim 2 wherein each of the breast members has a front wall with a crescent shape lower part that is sewn to a complementary upper part to structurally project the cup members outward of the patient's body.

7. The robe garment of claim 6 wherein each of the cup members includes a back wall, complementary to the front wall, which the back wall has a crescent shaped lower part that is sewn to a complementary upper part for deflecting outward against the front wall when supporting a natural breast and for forming the prosthesis pocket in cooperation with the front wall to receive a breast prosthesis.

8. The robe garment of claim 1 wherein the back panel includes a tension member extending across the neckline operatively interconnected to the shoulder straps.

9. The robe garment of claim 1 wherein the outer garment layer includes a shoulder seam extending from the neckline along the shoulder to the arm and wherein the shoulder straps of the inner panel are affixed to the shoulder seam of the outer panel.

* * * * *